US005664476A

United States Patent [19]

Lemaire et al.

[11] Patent Number: 5,664,476

[45] Date of Patent: Sep. 9, 1997

[54] PRESSURIZED FLUID MOTOR

[75] Inventors: Gilles Lemaire, Margny; Marc Perot, Eve; Jean-Pierre Alegre, Thourotte, all of France

[73] Assignee: Poclain Hydraulics, France

[21] Appl. No.: 623,146

[22] Filed: Mar. 28, 1996

[30] Foreign Application Priority Data

Mar. 31, 1995 [FR] France ..... 95 03805

[51] Int. Cl.[6] ..... F01B 1/06

[52] U.S. Cl. ..... 91/491; 91/474

[58] Field of Search ..... 91/474, 491; 417/502, 417/503; 60/484

[56] References Cited

U.S. PATENT DOCUMENTS 5,115,890 5/1992 Noel ..... 91/491
5,179,889 1/1993 Wüsthof et al. ..... 91/491

FOREIGN PATENT DOCUMENTS 1513265 4/1968 France ..... F03C 1/04
2205095 5/1974 France ..... F01B 31/00

*Primary Examiner*—Charles G. Freay
*Attorney, Agent, or Firm*—Ladas & Parry

[57] ABSTRACT

A pressurized fluid motor comprising a case, constituting its stator, and including connection ducts, a cylinder block rotatable about a first axis relative to a reaction member that is stationary relative to the case, and an internal fluid distributor that is likewise stationary relative to the case and that has distribution ducts. The case has a connection and fixing face that is plane and perpendicular to the first axis and into which the connection ducts open out. There exists a second axis perpendicular to and intersecting the first axis and lying in the plane of the face, relative to which the centers of the ends of the connection ducts are disposed in such a manner that the distance between each of them and said second axis lies in the range one-fourth to once the distance between said first axis and the point of the face that is furthest from said first axis, with the ends of the connection ducts all being situated on the same side of said second axis.

10 Claims, 4 Drawing Sheets

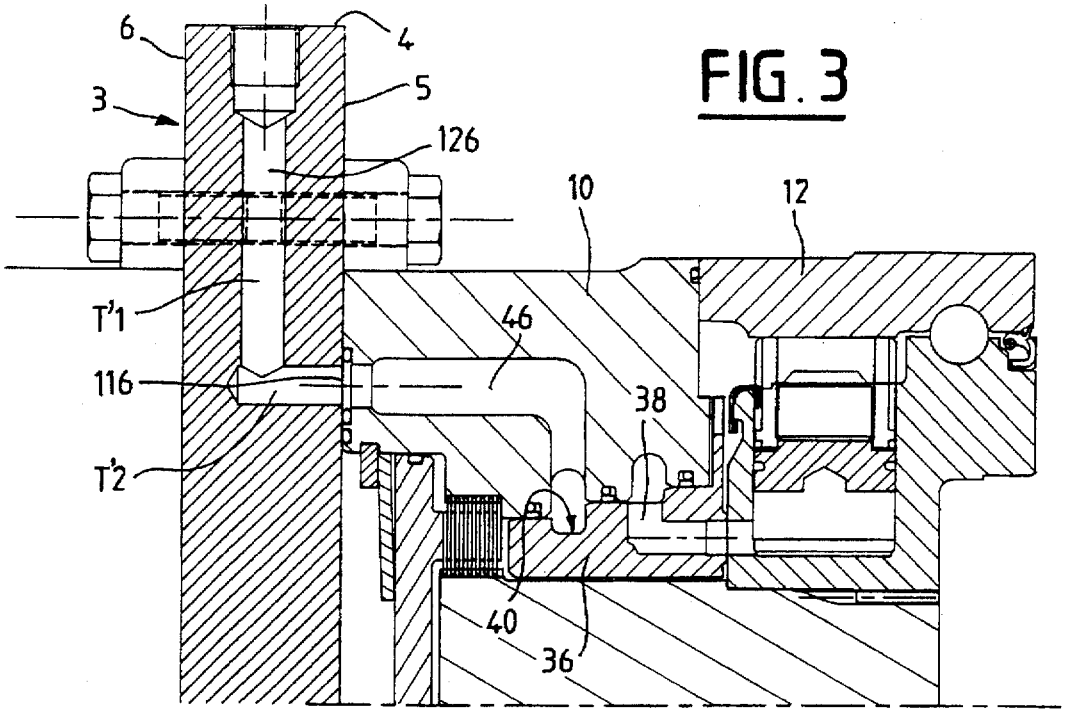
FIG. 3
FIG. 4
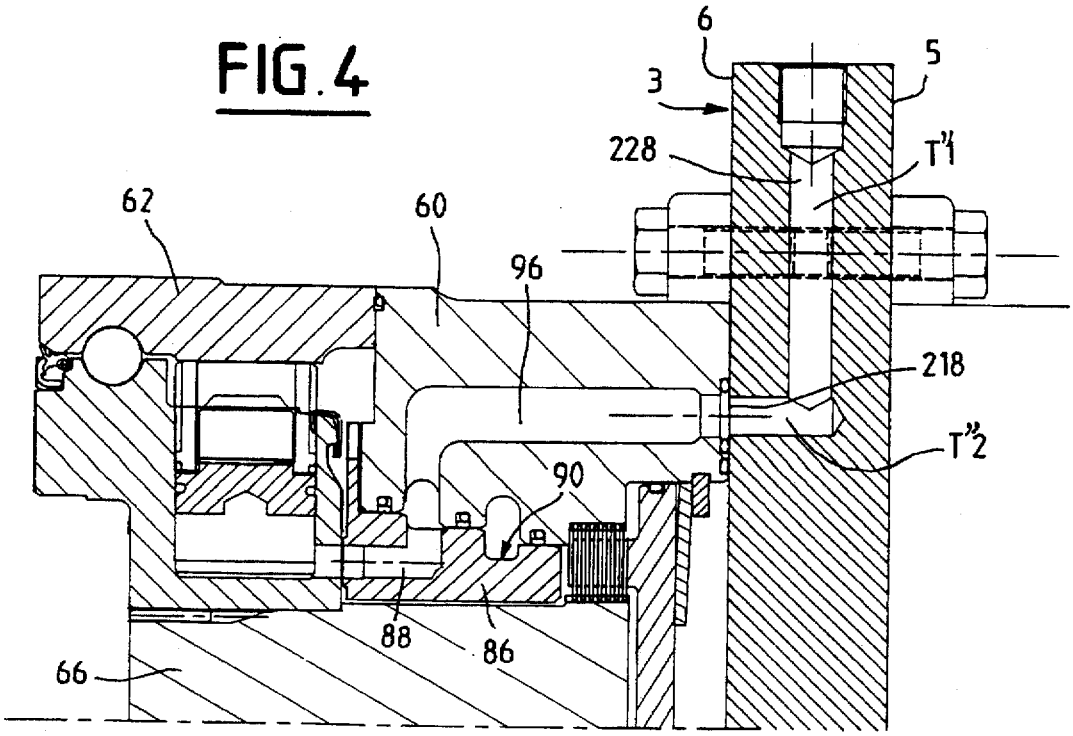

PRESSURIZED FLUID MOTOR

FIELD OF THE INVENTION

The present invention relates to a pressurized fluid motor comprising:

a case constituting the stator of the motor and including connection ducts, which ducts comprise main fluid feed and exhaust ducts and at least one auxiliary duct, the case being provided With fixing means for fixing to a pressurized fluid feed member;

a cylinder block mounted to rotate about a first axis relative to a reaction member which is secured to the case relative to rotation about said axis, and including a plurality of cylinders disposed radially relative to the first axis and suitable for being fed with pressurized fluid; and an internal fluid distributor secured to the case relative to rotation about the first axis and having distribution ducts suitable for putting the cylinders into communication with the main fluid feed and exhaust ducts.

BACKGROUND OF THE INVENTION

In certain applications, it is necessary to install such a motor in a space of small size. It is then important for it to be possible to couple and fix the case to the feed member in a minimum amount of room. For this purpose, the design of the motor must be such that the dimensions of the feed can be small and the organization of the various ducts of said member which are to be coupled to the connection ducts of the motor case can be simplified.

In some vehicles, each wheel (or compacting roller) is fitted with a motor of this type, and it is desirable for the two motors driving a pair of wheels on the same axis should be coupled to a common feed member of small size, constituting an integral portion of the vehicle chassis and capable of providing individualized feed to each of the two motors.

OBJECTS AND SUMMARY OF THE INVENTION

The present invention seeks to satisfy these requirements.

To this end, the case of the motor has a connection and fixing face that is plane and perpendicular to said first axis, into which face the connection ducts open out, each of said ducts having an end situated in the connection and fixing face and having a center. There exists a second axis perpendicular to and intersecting said first axis and situated in the plane of the connection and fixing face relative to which said centers are disposed in such a manner that the distance between each of them and said second axis lies in the range one-fourth to once the distance between the first axis and the point on the connection and fixing face that is furthest from said first axis, said ends of the connection ducts all being situated on the same side of the second axis.

This range of distances is determined for reasons that are explained below with reference to the drawings.

By means of these dispositions, the ends of the connection ducts of the motor case are all grouped together in a determined zone of the connection and fixing face, such that the ducts of the feed member can be short in length and can have their ends grouped together in a zone corresponding to said determined zone, thereby simplifying the organization thereof.

Advantageously, the centers of the ends of the connection ducts are substantially in alignment on a connection line.

This also makes it possible to cause the ducts of the feed member to open out on a common line, optionally relatively dose to one of the ends of said member.

Advantageously, such a motor is used in a pressurized fluid assembly that includes two identical motors and one feed member common to both motors. The feed member has first and second feed faces that are parallel and opposite, to which the connection and fixing faces of the first and second motors are respectively suitable for being fixed to form a coupled-together assembly.

The ducts in the feed member are referred below as "upstream ducts". Some upstream ducts open out into the first feed face to be coupled to the connection ducts of the first motor, and some upstream ducts open out into the second feed face to be coupled to the connection ducts of the case of the second motor. As explained below, some of the upstream ducts may open out into both feed faces, while others may open out selectively in one face or the other.

When the assembly is coupled together, the first axes of the first and second motors are aligned and there exist respective parallel second axes for the first and second motors. The ends of the connection ducts of the case of the first motor and the ends of the connection ducts of the case of the second motor are situated on the same sides of these respective second axes. In other words, the connection ducts of the first motor and the connection ducts of the second motor open out into zones of the connection and fixing faces which are situated substantially facing each other on either side of the feed member.

BRIEF DESCRIPTION OF THE DRAWINGS

The invention will be well understood and its advantages will appear more clearly on reading the following detailed description of an embodiment given by way of non-limiting example. The description refers to the accompanying drawings, in which:

FIGS. 3 and 4 are fragmentary axial section views perspectively on lines III—III and IV—IV of FIG. 2.

MORE DETAILED DESCRIPTION

Figure 1:
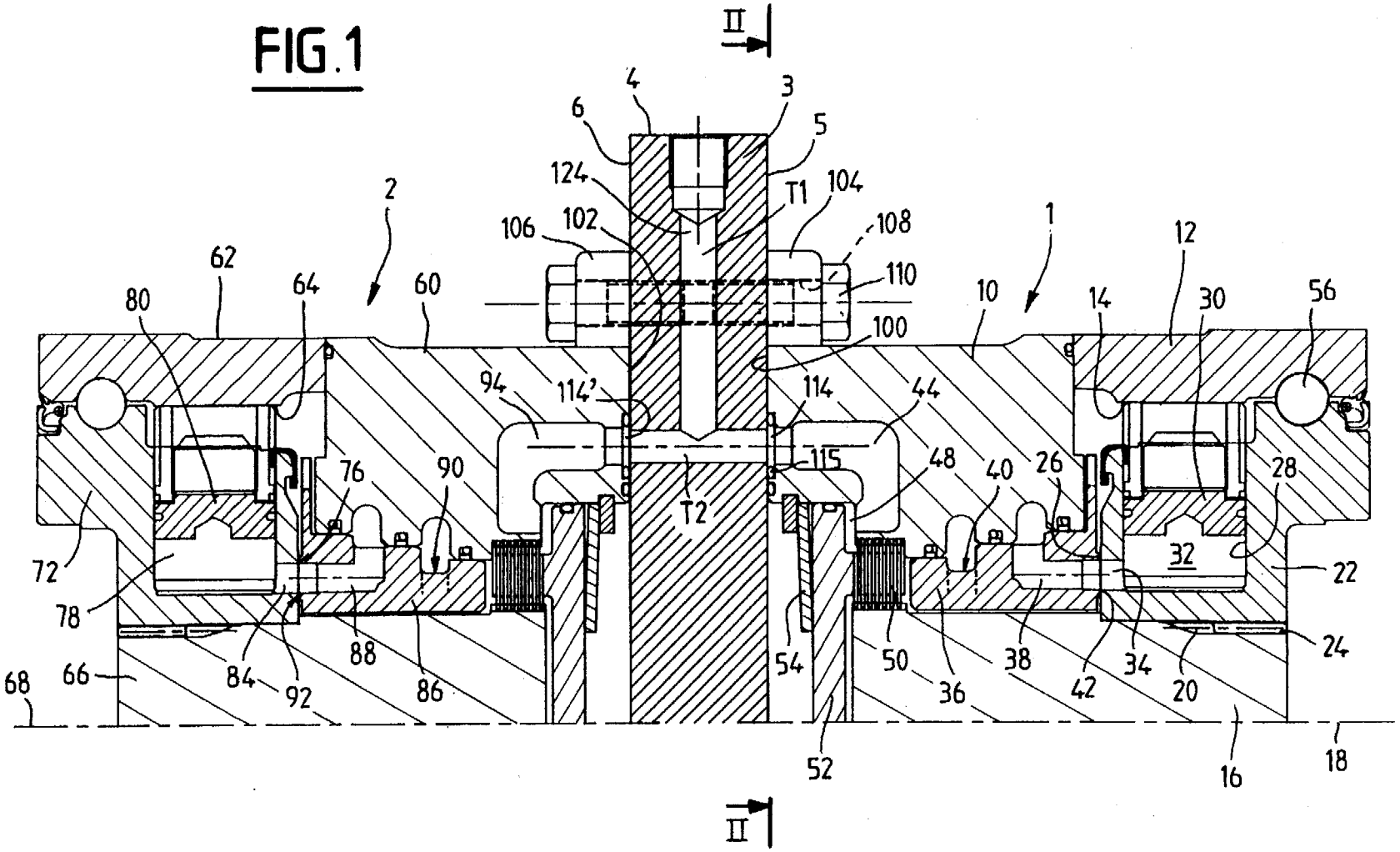
FIG. 1 is an axial section showing an assembly comprising two motors aligned in the section plane and fixed on either side of a feed member, with only the top half of the assembly being shown.

FIG. 1 shows show two motors 1 and 2 sharing a common feed member 3 which forms part of a vehicle chassis, for example.

The motor 1 comprises:

a case comprising two parts 10 and 12 assembled together by fixing means (not shown);

a reaction member such as a cam 14 constituted by the undulating inside periphery of the part 12 of the case;

a shaft 16 mounted to rotate relative to the case about an axis of rotation 18 and having coupling flutes 20;

a cylinder block 22 having a central bore provided with flutes 24 that co-operate with the flutes 20 on the shaft 16 so as to constrain the cylinder block 22 and the shaft 16 to rotate together about the axis 18, said cylinder block having a plane communication face 26 perpendicular to the axis 18;

a plurality of cylinders 28 disposed radially relative to the axis 18 inside the cylinder block 22;

pistons 30 slidably mounted inside the cylinders 28, each piston defining a fluid working chamber 32 inside its cylinder, which chamber communicates with the plane communication face 26 via a cylinder duct 34 that opens into said face; and an internal fluid distributor 36 secured to the case 10, 12 with respect to rotation about the axis 18 (by means such as pegs and notches, not shown) and having distribution ducts 38 and 40 opening out in the plane distribution face 42 of the distributor and bearing against the communication face 26 so as to be brought into alternating communication with the cylinder ducts.

The part 10 of the case includes connection ducts. These include an auxiliary duct 44 shown in FIG. 1, and a main fluid feed or exhaust duct 46 which is shown in FIG. 3.

The terra "auxiliary duct" is used to cover ducts whose functions are auxiliary compared with the main functions of the motor. By way of example, these may be break-release ducts, leakage return ducts, or cylinder-capacity selection control ducts for motors that have at least two active cylinder capacities. Thus, duct 44 is a break-release duct. It communicates with a break-release chamber 48 which is suitable for feeding pressurized fluid to inactivate braking disks 50 that are normally returned towards a braking position by a pusher 52 urged by a resilient washer 54.

The main duct 46 communicates with the distribution duct 40. It may constitute a feed duct, and it may feed the duct 40 with pressurized fluid so that, when the duct 40 is coupled to a cylinder duct, a piston is urged in the upwards direction. In which case, the distribution duct 38 may be coupled to a fluid exhaust duct disposed in a manner substantially analogous to that of the duct 46 but allowing fluid to be exhausted from the working chambers.

It may be observed that the motor shown is a motor whose cylinder capacity has staged distribution, i.e. the fluid feed or exhaust ducts on the one hand and the distribution ducts on the other hand are coupled respectively to staged grooves in the inner axial periphery of the part 10 of the case and to staged grooves in the outer axial periphery of the internal distributor 36.

Although such an example is not shown, the invention is equally applicable to motors having two cylinder capacities. In addition, distribution could be plane, i.e. the feed or exhaust ducts and the distribution ducts could be coupled together in the substantially plane radial faces of the distributor and of the case.

It should also be observed that rotation of the cylinder block relative to the part 12 of the case which carries the cam 14 is guided by ball bearings 56.

The motor 2 is identical to the motor 1 and comprises:

a fixed case comprising two parts 60 and 62;

a reaction cam 64;

a shaft 66 mounted to rotate about an axis 68 that is in alignment with the axis 18;

a cylinder block 72 that is secured to the shaft 66 with respect to rotation about the axis 68;

cylinders 78 having pistons 80 slidably mounted therein; and an internal fluid distributor 86 that is secured to the case 60 with respect to rotation about the axis 68 and having distribution ducts 88 and 90 opening out into the plane distribution face 92 so as to be put into contact with cylinder ducts 84 opening out into the plane communication face 76 of the cylinder block.

Case part 60 includes connection ducts, including a break-release auxiliary duct 94 which is visible in FIG. 1, and a main fluid feed or exhaust duct 96 which is visible in FIG. 4.

Case part 10 of the first motor 1 has a connection and fixing face 100 which is plane and perpendicular to the axis of rotation 18. The connection ducts of this motor open out in the face 100 and each of them has an end lying in the connection and fixing face and presenting a center therein. It may be observed, e.g. as a function of the degree of finish of this face, that said ends may be circular or merely roughly circular or indeed practically square. Nevertheless each of them has a geometrically definable center.

Similarly, the connection ducts of the second motor open out in the connection and fixing face 102 of that motor.

The two connection and fixing faces 100 and 102 are fixed on the two opposite faces of the feed plate 3. For this purpose, the case parts 10 and 60 are provided with respective fixing flanges 104 and 106 that terminate axially substantially in the same planes as the connection and fixing faces. The flanges 104 and 106 have holes 108 through which screws 110 can be inserted to cooperate with bores through the fixing plate 3.

Figure 2:
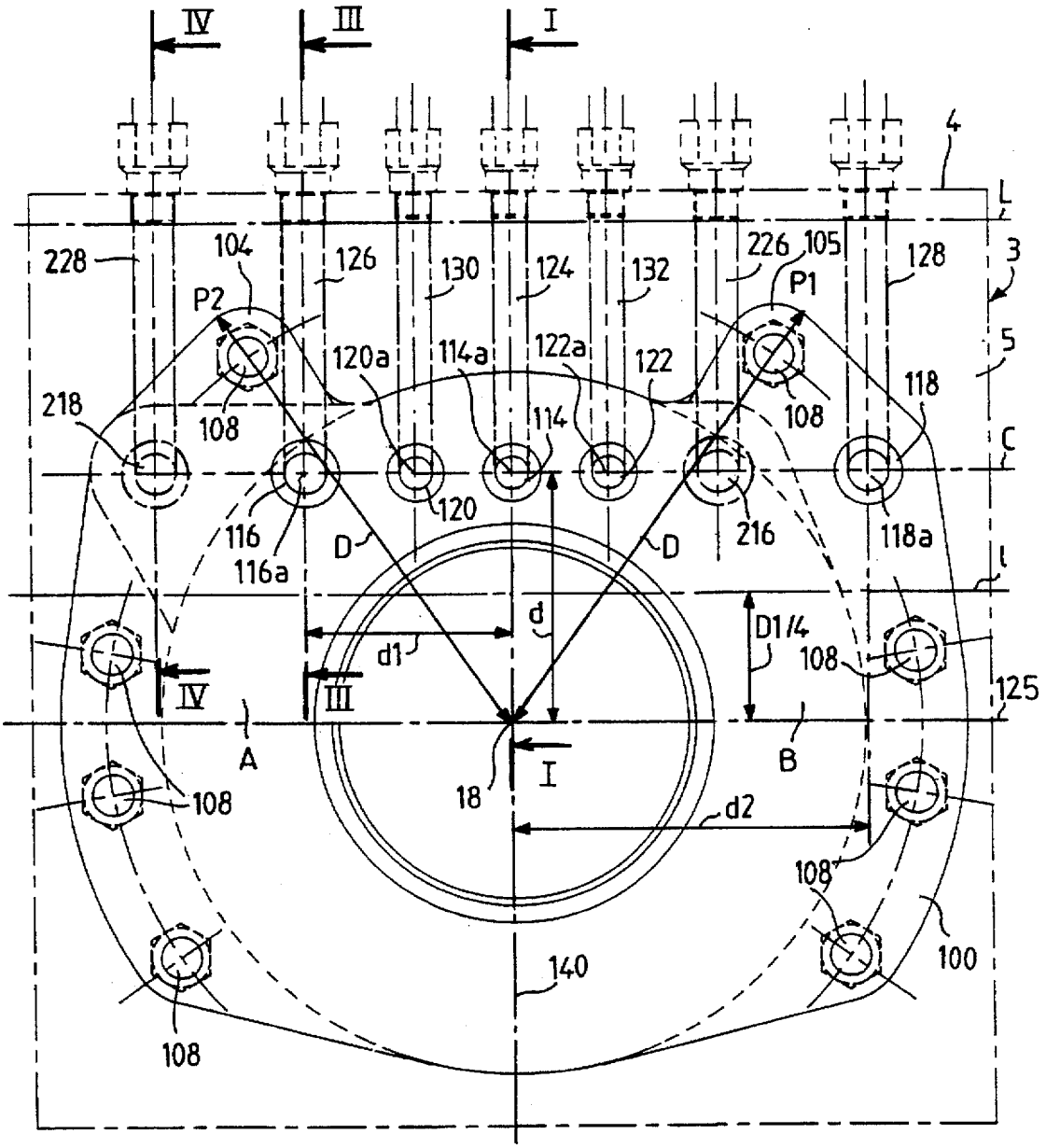
FIG. 2 is a fragmentary diagrammatic view on line II—II of FIG. 1.

FIG. 2 shows the connection and fixing face 100 of the motor 1. To clarify the explanation, certain elements of the assembly situated on the wrong side of the line II—II in FIG. 1 are nevertheless shown in FIG. 2, by using chain-dotted lines. This applies, for example, to the feed plate 3 and to some of the connection ducts of the motor 2.

The fixing flange of the motor 1 comprises two portions 104 and 105 having screw-receiving holes 108 distributed around their peripheries. The axis of rotation 18 of the cylinder block is marked diagrammatically in the center of the figure. To simplify the figure, none of the elements inside the case, such as the shaft, the distributor, or the brake disks are shown in the figure.

All of the connection ducts of the first motor open out into the connection and fixing face 100. Thus, there can be seen the end 114 of the break-release duct 44 and the end 116 of the feed or exhaust duct 46. There can also be seen the end 118 of an exhaust or feed duct, and the ends 120 and 122 of two auxiliary ducts.

Point P1 is the point on the connection and fixing face 100 that is furthest from the axis 18. It is situated at a distance D from the axis. The face 100 shown in FIG. 2 is symmetrical in shape, so there can be seen another point P2 situated likewise at the distance D from the axis 18.

Reference 125 of FIG. 2 designates a second axis that is perpendicular to and that intersects the first axis 18, which second axis is situated in the plane of the connection and fixing face 100. Chain-dotted line 1 constitutes the set of points which lie at a distance ¼D from the axis 125 and which lie on one side thereof, the distance ¼D being equal to one-fourth of the distance D. The line L on the same side of the axis 125 constitutes the set of points located at distance D therefrom. It can be seen that the centers 114*a*, 116*a*, 118*a*, 120*a*, and 122*a* of the ends 114, 116, 118, 120, and 122 of the connection ducts are situated between the lines 1 and L, i.e. they are disposed in such a manner that their distances from the second axis lies in the range one-fourth of the distance D and said distance D.

In FIG. 2, the upstream ducts, i.e. the ducts of the feed member 3, are shown in chain-dotted lines. The upstream ducts 124, 126, 128, 130, and 132 are coupled respectively to the ends 114, 116, 118, 120, and 122 of the connection ducts of the motor 1.

With reference to FIG. 1, it can be seen that the feed member 3 has a coupling face 4 from which the upstream ducts run, a first feed face 5 into which the upstream ducts open out to be coupled to the connection ducts of the first motor, and a second feed face 6 into which the upstream ducts open out to be coupled to the connection ducts of the second motor. When the coupling face 4 is plane, as shown in FIG. 2, then a second axis 125 relative to which the distance of the centers of the ends of the connection ducts satisfy the above-specified relationship is advantageously parallel to said face 4 when the motor is fixed to the feed member.

It can be seen that by satisfying this relationship, it is possible to ensure that the upstream ducts extend within the feed member over a relatively small distance only, thereby serving both to limit bulk and to facilitate machining of the feed member.

By ensuring that the distance of the centers of the connection ducts from the axis 125 is not less than ¼D, it is possible to locate the ends of said ducts within a zone of sufficient size, because it is relatively remote from the center of the motor, both to be able to group the ends together close to a peripheral portion of the motor, and to be able to keep their centers far enough apart from one another for the upstream ducts to which they correspond respectively to be capable of being made in a single sheet within the thickness of the feed member, thereby enabling said thickness to be kept small. It may be observed that certain portions of the fixing flanges can be used to receive the ends of the distribution ducts, as shown in FIG. 2.

More precisely, the case 10 is generally cylindrical in shape (not including its fixing flange). If the ends of some of the connection ducts were to have their centers situated on one side of the axis 125 at a distance of less than ¼D therefrom, i.e. in the relatively narrow zones A or B of the face 100, then those ends would be rather inaccessible between the inner periphery and the outer periphery of the cylinder. Given the narrowness of these zones, it would then not be possible to group the ends of a plurality of connection ducts therein, and that would prevent the organization of the ducts in the feed member being simplified.

As shown in FIG. 2, it is advantageous for the centers of the ends of the connection ducts to be substantially in alignment on a connection line C. In which case, there is a second axis parallel to the line C and relative to which the distance from the centers of the connection ends lies in the range ¼D to D. These centers are all situated at the same distance d from said second axis. Thus, if the feed member is made in such a way that the coupling face 4 is parallel to the line C when the first motor is fixed to said member, then all of the upstream ducts thereof can be mutually parallel (and perpendicular to the face 4) and can extend over substantially the same length.

When the assembly is coupled together as shown in FIG. 1, the connection lines of the two motors 1 and 2 are parallel and situated facing each other on opposite sides of the feed member. In other words, the plane containing these two connection lines is parallel to the aligned first axes of the two motors.

As can be seen in the axial sections of FIGS. 1, 3, and 4, the upstream ducts of the feed member advantageously include rectilinear inlet lengths (T1, T'1, T"1) extending perpendicularly to the coupling face 4 over a length substantially equal to the distance between said face 4 and the ends of the motor connection ducts when the motor is coupled to the feed member. Thereafter, each upstream duct includes another rectilinear length (T2, T'2, T"2) perpendicular to the first and extending towards one or both feed faces. In other words, the upstream ducts are generally L-shaped or upside-down T-shaped in axial section.

Gaskets 115 seal the couplings between the connection ducts and the upstream ducts.

Reference 140 in FIG. 2 designates a third axis perpendicular to the connection line C, and perpendicular to and intersecting the first axis 18, said third axis being situated in the plane of the connection and fixing face. It can be seen that the center 114*a* of the end 114 of a connection duct of the first motor lies on this third axis.

FIG. 1 is a section on line I—I of FIG. 2, i.e. in the plane defined by the first axis 18 and by the third axis 140. This special position of one of the ducts, referred to below as the "middle duct", is particularly advantageous in the context of the coupled-together assembly shown in FIG. 1. Thus, each of the motors 1 and 2 has an identical middle duct 44 (or 94) with the ends 114 and 114' thereof facing each other on opposite sides of the feed member 3. Thus, to put these two connection ducts into communication with each other, it suffices to provide the upstream duct 124 with a through length T2 extending transversely to the faces 5 and 6 and passing through the member 3 between its two faces. In the example shown, the middle duct is a break-release duct. It could equally well be some other auxiliary duct, such as a leakage return duct.

As can also be seen in FIG. 2, the ends 120 and 122 of the two connection ducts of the motor 1 are disposed symmetrically about the third axis 140. The pair constituted in this way is referred to as a "symmetrical pair".

Thus, by making the upstream ducts 130 and 132 in the same manner as above-described duct 124, i.e. as upside-down T-shapes, for example, the symmetrical pair of ducts of the two motors can be put into communication.

The connection ducts of the symmetrical pair arc preferably interconnected inside the motor. By way of example, they may open out into a common groove. In which case, it is possible to eliminate one of the upstream ducts 130 and 132, or else to give these ducts an L-shape with each opening out into a corresponding respective one of the feed faces 5 and 6.

Like the above-described middle duct, they may also constitute auxiliary ducts and serve to synchronize the auxiliary functions of the two motors. In the example, it should be observed that there are shown one middle duct and one symmetrical pair, thereby enabling the middle duct to have one hydraulic function and the symmetrical pair to have another hydraulic function. If it is desired to be able to control both motors simultaneously with respect to one hydraulic function only, then it is possible to provide either the middle duct on its own or else a single symmetrical pair on its own. In contrast, if it is desired to be able to control more than two functions simultaneously, then it is possible to provide one middle duct, plus at least two symmetrical pairs of ducts.

Figure 5:
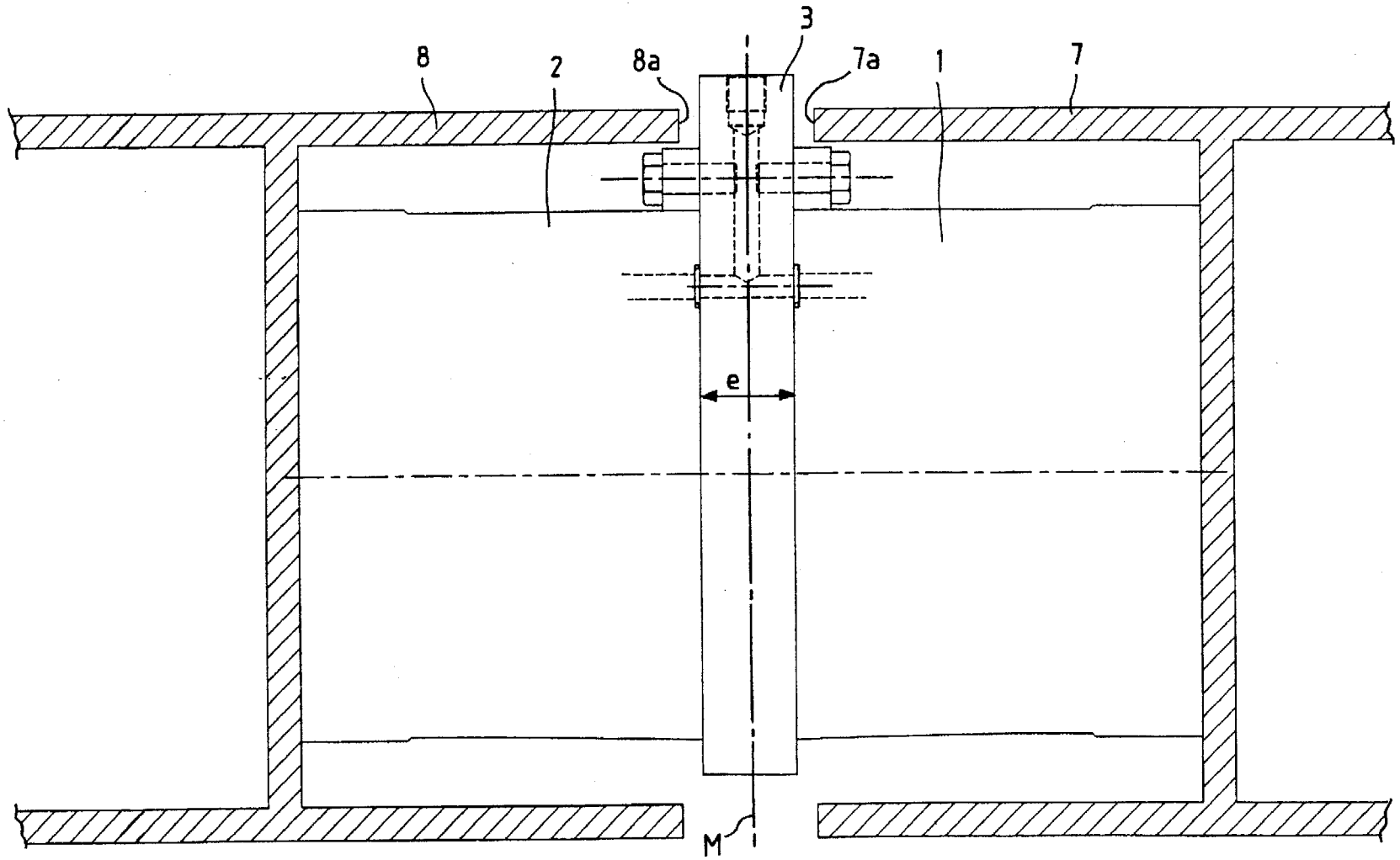
FIG. 5 is a diagrammatic view showing the position of the assembly relative to the wheels of a vehicle once installed.

It is often desirable not to synchronize all the functions of both motors. Thus, as shown in FIG. 5, when the motors 1 and 2 are mounted in the wheels or rollers 7 and 8 of a moving device, it may be desirable to control the rotary speeds of the two motors independently from each other so that the two wheels constitute independent drive wheels.

In which case, the main fluid feed or exhaust ducts of the motor 1 may be "individualized ducts", each having one end situated on one side of the third axis 140, whereas on the other side of said third axis, in a position symmetrical to the position of said end, the connection and fixing face of the motor has no end of some other connection duct present therein.

The end 116 of duct 46 lies on a first side of the axis 140 and at a distance d1 therefrom. On the other side of this axis, and at the same distance d1, the end 216 of a duct analogous to the duct 46, but forming a part of the second motor, i.e. situated in the connection and fixing face 102, is shown in chain-dotted lines. At this location, the connection and fixing face 100 of the first motor is solid, as is the feed face 5 of the feed member 3. Since the first axes 18 and 68 of the motors 1 and 2 are in alignment when the motors are both fixed to the feed member 3, the end 216 lies naturally in a position that is symmetrical to the end 116.

As shown in FIG. 3, the upstream duct 126 feeds, in particular, connection duct 46 and is L-shaped, with its bottom length T'2 extending towards feed face 5. Analogously, the upstream duct 226 can feed individually a duct that is analogous to connection duct 46 but that forms a portion of the second motor, thus being L-shaped with its bottom length directed towards feed face 6 of the member 3.

The end 118 of another connection duct of the first motor lies at a distance d2 from the axis 140. On the other side of this axis, and at the same distance d2, there is no end of any other connection duct of the first motor, but there is the end 218 of a duct of the second motor which is analogous to said connection duct and is shown in chain-dotted lines. End duct 118 is likewise an individualized duct and can be fed in individualized manner via upstream duct 128. Naturally the same applies to duct 96 which can be seen more clearly in FIG. 4, whose end 218 is suitable for being fed individually via upstream duct 228. In section, this upstream duct is in the form of a reversed L-shape with its bottom length T"2 extending towards feed face 6.

In order to be able to control the speeds of rotation of the motors in independent manner, the individualized ducts of motor 1, and the individualized ducts of motor 2 may constitute fluid feed and exhaust ducts. Thus, in the example shown, the auxiliary ducts of both motors may be common (using a middle duct or a symmetrical pair of ducts), while the fluid feed and exhaust ducts are independent for each of the two motors.

Nevertheless, in some applications, it may be desirable for the speeds of rotation of the two motors to be synchronized. Under such circumstances, the fluid feed and exhaust ducts may be common for both motors, one of them possibly constituting a middle duct while the other one is doubled up to constitute a symmetrical pair of ducts. It may also be desirable for certain auxiliary functions of the motors to be controlled independently from one motor to the other, in which case the corresponding auxiliary ducts may be constituted by individualized ducts.

Certain workshop vehicles intended for use under special conditions may have wheels that are extremely wide, while the space between the wheels is very narrow. For such vehicles, it is particularly advantageous to use a coupled-together assembly comprising two motors of the invention, with their feed member being constituted by a feed plate that forms part of the vehicle chassis and that extends between the adjacent ends *7a*, *8a* of the two wheels 7, 8 as shown in FIG. 5. By way of example, the wheels may be fixed to the cylinder blocks of the motors. As mentioned above, the dispositions of the invention make it possible to feed the two motors individually by means of a common feed member 3.

The thickness e of the feed member can be particularly small, since given the special dispositions of the ends of the connection ducts of the motors, the sheet of upstream ducts in said feed member can be centered on the midplane M of the plate 3. Thus, only one duct is formed at a time in a given zone in the thickness of said plate.

We claim:

1. A pressurized fluid motor comprising:

a case constituting the stator of the motor and including connection ducts, which ducts comprise main fluid feed and exhaust ducts and at least one auxiliary duct, the case being provided with fixing means for fixing to a pressurized fluid feed member;

a cylinder block mounted to rotate about a first axis relative to a reaction member which is secured to the case relative to rotation about said axis, and including a plurality of cylinders disposed radially relative to the first axis and suitable for being fed with pressurized fluid; and an internal fluid distributor secured to the case relative to rotation about the first axis and having distribution ducts suitable for putting the cylinders into communication with the main fluid feed and exhaust ducts;

wherein the case has a connection and fixing face that is plane and perpendicular to said first axis, into which face the connection ducts open out, each of said ducts having an end situated in the connection and fixing face and having a center, and wherein there exists a second axis perpendicular to and intersecting said first axis and situated in the plane of the connection and fixing face relative to which said centers are disposed in such a manner that the distance between each of them and said second axis lies in the range one-fourth to once the distance between the first axis and the point on the connection and fixing face that is furthest from said first axis, said ends of the connection ducts all being situated on the same side of the second axis.

2. A motor according to claim 1, wherein the centers of the ends of the connection ducts are substantially in alignment on a connection line.

3. A motor according to claim 2, wherein the center of the end of one of the connection ducts, referred to as the "middle duct", lies on a third axis perpendicular to the connection line and perpendicular to and intersecting the first axis, being situated in the plane of the connection and fixing face.

4. A motor according to claim 3, wherein the middle duct is an auxiliary duct.

5. A motor according to claim 2, wherein the centers of the ends of a pair of connection ducts, referred to as a "symmetrical" pair, are disposed symmetrically about a third axis perpendicular to the connection line and perpendicular to and intersecting the first axis, being situated in the plane of the connection and fixing face.

6. A motor according to claim 5, wherein the connection ducts of the symmetrical pair are coupled together inside the motor and constitute auxiliary ducts.

7. A motor according to claim 2, wherein, given a third axis perpendicular to the connection line and perpendicular to and intersecting the first axis, being situated in the plane of the connection and fixing face, for at least one connection duct referred to as an "individualized" duct, having its ends situated on one side of the third axis, no end of another connection duct is to be found on the other side of said third axis in a position symmetrical to that of the end of the individualized duct.

8. A motor according to claim 7, wherein the individualized duct constitutes a main fluid feed or exhaust duct.

9. A pressurized fluid assembly, including identical first and second motors according to claim 1, together with a feed member having first and second feed faces that are parallel and opposite, to which the connection and fixing faces of the first and second motors are respectively suitable for being fixed to form a coupled-together assembly;

said feed member including "upstream" ducts which open out into the first feed face to be coupled to the connection ducts of the case of the first motor, and upstream ducts opening out in the second feed face to be coupled to the connection ducts of the case of the second motor; and when the assembly is coupled together, the first axes of the first and second motors are in alignment, and there exist respective second axes for the first and second motors that are parallel, with the ends of the connection ducts of the first motor and the ends of the connection ducts of the second motor being situated on the same sides of said respective second axes.

10. An assembly according to claim 9, comprising two motors in which the centers of the ends of the connection ducts are substantially in alignment on a connection line, and wherein, when the assembly is coupled together, the connection lines of the two motors are parallel and situated facing each other, on either side of the feed member.

* * * * *